United States Patent [19]

Weaver et al.

[11] Patent Number: 4,701,439

[45] Date of Patent: Oct. 20, 1987

[54] YELLOW DYE-DONOR ELEMENT USED IN THERMAL DYE TRANSFER

[75] Inventors: Max A. Weaver; William H. Moore, both of Kingsport, Tenn.; Kin K. Lum, Webster, N.Y.

[73] Assignee: Eastman Kodak Company, Rochester, N.Y.

[21] Appl. No.: 933,505

[22] Filed: Nov. 21, 1986

Related U.S. Application Data

[63] Continuation-in-part of Ser. No. 813,207, Dec. 24, 1985, abandoned.

[51] Int. Cl.[4] ..... B41M 5/26

[52] U.S. Cl. ..... 503/227; 8/471; 427/146; 427/256; 428/195; 428/207; 428/480; 428/913; 428/914; 430/945

[58] Field of Search ..... 8/470, 471; 346/227; 428/195, 207, 411.1, 480, 484, 488.1, 488.4, 913, 914; 427/146, 256

[56] References Cited

U.S. PATENT DOCUMENTS

| | | | |
|---|---|---|---|
| 3,247,211 | 4/1966 | Weaver et al. | 260/287 |
| 3,453,280 | 7/1969 | Weaver et al. | 260/287 |
| 3,917,604 | 11/1975 | Hoyle | 260/283 CN |
| 4,180,663 | 12/1979 | Frishberg | 544/105 |

FOREIGN PATENT DOCUMENTS

| | | | |
|---|---|---|---|
| 31564 | 2/1985 | Japan | 8/471 |
| 31563 | 2/1985 | Japan | 8/471 |
| 28451 | 2/1985 | Japan | 8/471 |
| 28452 | 2/1985 | Japan | 8/471 |
| 28453 | 2/1985 | Japan | 8/471 |

*Primary Examiner*—Bruce H. Hess
*Attorney, Agent, or Firm*—Harold E. Cole

[57] ABSTRACT

A yellow dye-donor element for thermal dye transfer comprises a support having thereon a yellow dye dispersed in a polymeric binder, the yellow dye having the formula:

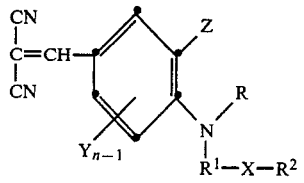

wherein

R is a substituted or unsubstituted alkyl group of from 1 to about 10 carbon atoms; a cycloalkyl group of from about 5 to about 7 carbon atoms; or represents the atoms which when taken together with Z forms a 5- or 6-membered ring;

$R^1$ is an alkylene or substituted alkylene group;

X is —OJO—, —OJ—, —JO—, —OJNR$^3$—, —NR$^3$J—, —NR$^3$JNR$^3$, —JNR$^3$— or —NR$^3$JO—;

J is CO or $SO_2$;

$R^3$ is hydrogen; a substituted or unsubstituted alkyl group of from 1 to about 10 carbon atoms; a substituted or unsubstituted aryl group of from about 6 to about 10 carbon atoms; or represents the atoms which when taken together with $R^2$ forms a 5- or 6-membered ring;

$R^2$ is a substituted or unsubstituted alkyl group of from 1 to about 10 carbon atoms; a cycloalkyl group of from about 5 to about 7 carbon atoms; a substituted or unsubstituted aryl group of from about 6 to about 10 carbon atoms; or represents the atoms which when taken together with $R^3$ forms a 5- or 6-membered ring;

Z is hydrogen or represents the atoms which when taken together with R forms a 5- or 6-membered ring;

Y is a substituted or unsubstituted alkyl or alkoxy group of from 1 to about 6 carbon atoms or halogen; and n is a positive integer from 1 to 4.

19 Claims, No Drawings

YELLOW DYE-DONOR ELEMENT USED IN THERMAL DYE TRANSFER

This application is a continuation-in-part of U.S. application Ser. No. 813,207, filed Dec. 24, 1985 now abandoned.

This invention relates to yellow dye-donor elements used in thermal dye transfer which have good dye stability and low retransfer properties.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

A problem has existed with the use of certain dyes in dye-donor elements for thermal dye transfer printing. Many of the dyes proposed for use do not have adequate stability to light. Others exhibit a phenomenon called "retransfer". This occurs when the dye which has transferred from the donor element to a dye-receiving element, where it is supposed to remain, "retransfers" to another support, causing a loss in dye density in the dye-receiving element and an unwanted dye image in that other support.

It would be desirable to provide dyes which have good light stability and which do not retransfer to other unwanted supports.

U.S. Pat. Nos. 3,247,211, 3,453,280, 3,917,604 and 4,180,663 relate to cyanovinyl-tetrahydroqunoline dyes similar to those used in the invention. They are described as textile dyes, however, and have no teaching that such dyes could be used in a dye-donor element for thermal dye transfer.

Japanese Patent Publication No. 60/031564 relates to a tricyanovinylquinoline dye. This dye is magenta, however, and not yellow like the dyes of this invention.

Japanese Publication Nos. 60/031563, 60/028451, 60/028452 and 60/028453 relate to various di-and tricyanoaniline dyes. These dyes are structurally different from the compounds employed in the invention, and as will be shown by comparative tests hereinafter, several di-cyanoaniline dyes which were tested for light stability were significantly poorer than the compounds employed in this invention.

Substantial improvements in the above problems are achieved in accordance with this invention which comprises a yellow dye-donor element for thermal dye transfer comprising a support having thereon a dye layer comprising a yellow dye dispersed in a polymeric binder, the yellow dye having the formula:

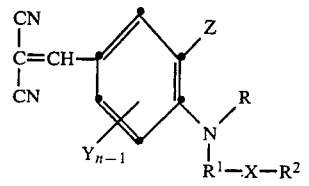

wherein

R is a substituted or unsubstituted alkyl group of from 1 to about 10 carbon atoms, such as methyl, ethyl, propyl, isopropyl, butyl, pentyl, hexyl or such alkyl groups substituted with hydroxy, acyloxy, alkoxy, aryl, cyano, acylamido, halogen, etc.; a cycloalkyl group of from about 5 to about 7 carbon atoms such as cyclopentyl, cyclohexyl, p-methylcyclohexyl, etc.; or represents the atoms which when taken together with Z forms a 5- or 6-membered ring;

$R^1$ is an alkylene or substituted alkylene group such as methylene, ethylene, hexylene, etc. or alkylene substituted with hydroxy, alkoxy, aryl, cyano, halogen, etc.;

X is —OJO—,—OJ—, —JO—, —OJNR$^3$—, —NR$^3$J—, —NR$^3$JNR$^3$, —JNR$^3$— or —NR$^3$JO—;

J is CO or $SO_2$;

$R^3$ is hydrogen; a substituted or unsubstituted alkyl group of from 1 to about 10 carbon atoms such as those listed above for R; a substituted or unsubstituted aryl group of from about 6 to about 10 carbon atoms such as phenyl, p-tolyl, m-chlorophenyl, p-methoxyphenyl, m-bromophenyl, o-tolyl, etc.; or represents the atoms which when taken together with $R^2$ forms a 5- or 6-membered ring;

$R^2$ is a substituted or unsubstituted alkyl group of from 1 to about 10 carbon atoms, such as those listed above for R; a cycloalkyl group of from about 5 to about 7 carbon atoms, such as those listed above for R; a substituted or unsubstituted aryl group of from about 6 to about 10 carbon atoms, such as those listed above for $R^3$; or represents the atoms which when taken together with $R^3$ forms a 5- or 6-membered ring;

Z is hydrogen or represents the atoms which when taken together with R forms a 5- or 6-membered ring;

Y is a substituted or unsubstituted alkyl or alkoxy group of from 1 to about 6 carbon atoms, such as those listed above for R, methoxy, ethoxy, etc., or halogen such as chloro, bromo or fluoro; and n is a positive integer from 1 to 4.

In a preferred embodiment of the invention, R in the above structural formula represents the atoms which are taken together with Z to form a 6-membered ring. In another preferred embodiment of the invention, X is —OCONH— or —OCO—. In yet another preferred embodiment of the invention, $R^1$ is ethylene. In yet still another preferred embodiment of the invention, X is —NCH$_3$SO$_2$— or —NR$^3$J—, wherein J is CO and $R^3$ is combined with $R^2$ to form a 5- or 6-membered ring. In yet still another preferred embodiment of the invention, $R^2$ is a substituted aryl group of from about 6 to about 10 carbon atoms or $C_6H_5$.

The compounds employed in the invention may be prepared by any of the processes disclosed in U.S. Pat. Nos. 3,917,604, 4,180,663 and 3,247,211 referred to above, the disclosures of which are hereby incorporated by reference.

Compounds included within the scope of the invention include the following:

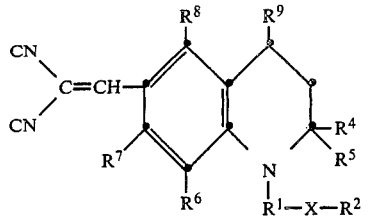

| Compound No. | $R^9$ | $R^4$ | $R^5$ | $R^6$ | $R^7$ | $R^8$ | $R^1$ | $X-R^2$ |
|---|---|---|---|---|---|---|---|---|
| 1 | $CH_3$ | $CH_3$ | $CH_3$ | H | $CH_3$ | H | $C_2H_4$ | $OC(=O)NHC_6H_5$ |
| 2 | $CH_3$ | $CH_3$ | $CH_3$ | H | H | H | $C_2H_4$ | $OC(=O)NHC_6H_5$ |
| 3 | H | H | $CH_3$ | H | $CH_3$ | H | $C_2H_4$ | $OC(=O)NHC_6H_5$ |
| 4 | H | H | $CH_3$ | $OCH_3$ | H | $CH_3$ | $C_2H_4$ | $OC(=O)NHC_6H_5$ |
| 5 | $CH_3$ | $CH_3$ | $CH_3$ | H | $CH_3$ | H | $CH_2CH(CH_3)$ | $OC(=O)NHC_6H_5$ |
| 6 | $CH_3$ | $CH_3$ | $CH_3$ | H | $CH_3$ | H | $CH_2CH(OC(=O)CH_3)CH_2$ | $OC(=O)CH_3$ |
| 7 | $CH_3$ | $CH_3$ | $CH_3$ | H | $CH_3$ | H | $CH_2CH(OC(=O)NHC_2H_5)CH_2$ | $OC(=O)NHC_6H_5$ |
| 8 | $CH_3$ | $CH_3$ | $CH_3$ | H | $CH_3$ | H | $CH_2CH_2CH_2$ | $NHC(=O)NHC_6H_5$ |
| 9 | $CH_3$ | $CH_3$ | $CH_3$ | H | $CH_3$ | H | $CH_2CH_2CH_2$ | $NHC(=O)OC_6H_5$ |
| 10 | $CH_3$ | $CH_3$ | $CH_3$ | H | $CH_3$ | H | $CH_2CH_2$ | 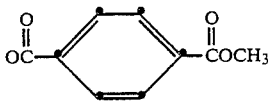 |
| 11 | H | H | $CH_3$ | H | Cl | H | $CH_2CH_2$ | 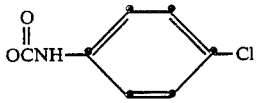 |
| 12 | H | H | $CH_3$ | H | $CH_3$ | H | $CH_2CH(OC(=O)OC_2H_5)CH_2$ | $OC(=O)OC_2H_5$ |
| 13 | H | H | $CH_3$ | H | $CH_3$ | H | $CH_2CH_2$ | 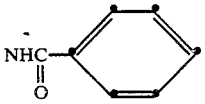 |

-continued

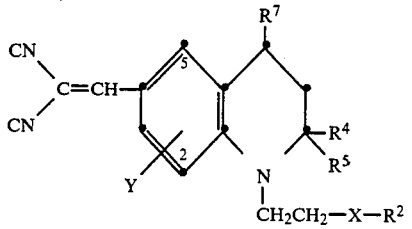

| Compound No. | $R^7$ | $R^4$ | $R^5$ | Y | X—$R^2$ |
|---|---|---|---|---|---|
| 14 | $CH_3$ | $CH_3$ | $CH_3$ | 3-$CH_3$ | —OCO—NH($C_6H_5$) |
| 15 | $CH_3$ | $CH_3$ | $CH_3$ | 3-$CH_3$ | —OCO—$CH_2OC_6H_5$ |
| 16 | $CH_3$ | $CH_3$ | $CH_3$ | 2-$OCH_3$ 5-$CH_3$ | —OCO—NH[$C_6H_5$—3,5-$(OCH_3)_2$] |
| 17 | $CH_3$ | $CH_3$ | $CH_3$ | 2-$OCH_3$ 5-$CH_3$ | —OCO—($C_6H_4$—4-$CO_2CH_3$) |
| 18 | $CH_3$ | $CH_3$ | $CH_3$ | 2-$OCH_3$ 5-$CH_3$ | —N(—$CH_3$)(—$SO_2C_6H_5$) |
| 19 | $CH_3$ | $CH_3$ | $CH_3$ | 3-$CH_3$ | 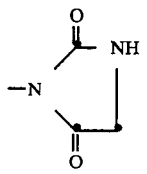 |
| 20 | 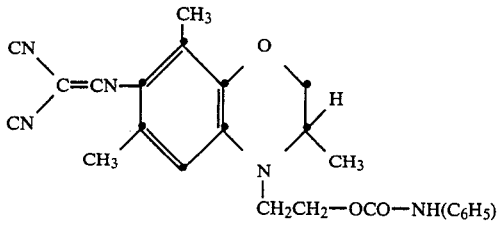 | | | | |
| 21 | 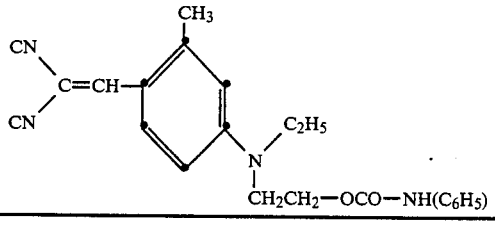 | | | | |

A dye-barrier layer may be employed in the dye-donor elements of the invention to improve the density of the transferred dye. Such dye-barrier layer materials include hydrophilic materials such as those described and claimed in application Ser. No. 813,294 entitled "Dye-Barrier Layer for Dye-Donor Element Used in Thermal Dye Transfer" by Vanier, Lum and Bowman, filed Dec. 24, 1985, now abandoned.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/$m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the yellow dye thereon as described above or may have alternating areas of other different dyes, such as sublimable cyan and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and the yellow dye as described above, and the above process steps are sequentially performed for each color to obtain a three-color dye transfer image. Of course, when the process is only preformed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A yellow dye-donor element was prepared by coating the following layers in the order recited on a 6 μm poly(ethylene terephthalate) support:

(1) Dye-barrier layer of gelatin nitrate (gelatin, cellulose nitrate and salicyclic acid in approximately 20:5:2 weight ratio in a solvent of acetone, methanol and water) (0.33 g/m$^2$), and (2) Dye layer containing a yellow dye as identified in the following Table 1 (0.22 g/m$^2$) in cellulose acetate (40% acetyl) (0.44 g/m$^2$) coated from 2-butanone and acetone. If the dye had limited solubility, a small amount of tetrahydrofuran was also added.

On the back side of the element, a slipping layer of Beeswax (0.55 g/m$^2$) in cellulose acetate butyrate (0.55 g/m$^2$) was coated from tetrahydrofuran solvent.

TABLE 1

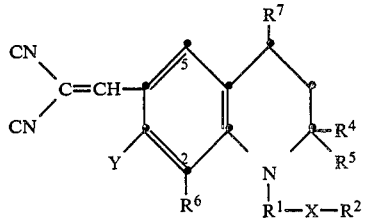

| Dye | $R^7$ | $R^4$ | $R^5$ | $R^6$ | Y | $R^1$—X—$R^2$ |
|---|---|---|---|---|---|---|
| Compound 1 | $CH_3$ | $CH_3$ | $CH_3$ | H | 3-$CH_3$ | $C_2H_4O_2CNHC_6H_5$ |
| Control 1 | $CH_3$ | $CH_3$ | $CH_3$ | H | 3-$CH_3$ | $C_2H_5$ |
| Control 2 | H | $CH_3$ | H | $OCH_3$ | 5-$CH_3$ | $C_2H_4Cl$ |

TABLE 1-continued

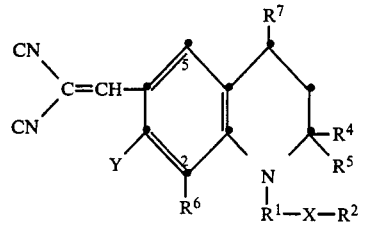

| Dye | $R^7$ | $R^4$ | $R^5$ | $R^6$ | Y | $R^1$—X—$R^2$ |
|---|---|---|---|---|---|---|
| Control 3 | 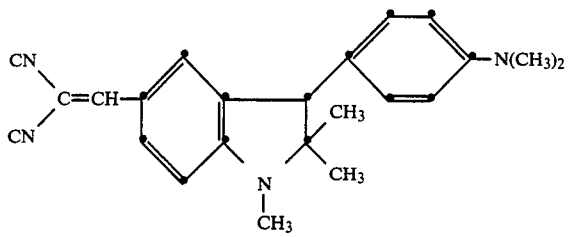 | | | | | |
| Control 4 | 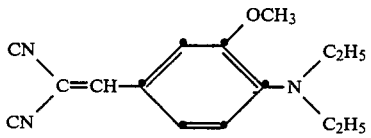 | | | | | |
| Control 5 | 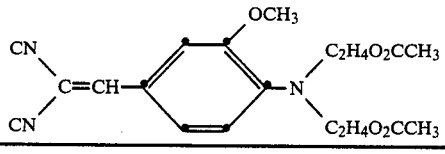 | | | | | |

A dye-receiving element was prepared by coating a solution of Makrolon 5705 ® (Bayer A.G.) polycarbonate resin (2.9 g/m$^2$) in a solvent mixture of methylene chloride and trichloroethylene on an ICI Melinex 990 ® white polyester support.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated to 0.5 msec increments from 0 to 4.5 msec to generate a graduated density test pattern. The voltage supplied to the print head was approximately 19 v representing approximately 1.75 watts/dot. Estimated head temperature was 250°–400° C.

The dye-receiving element was separated from the dye-donor element and the Status A blue density of the step image was read. The image was then subjected to "HID-fading": 4 days, 50 kLux, 5400° K., 32° C., approximately 25% RH. The density loss at a density near 1.0 was calculated.

The following dye stability data were obtained:

TABLE 2

| Dye | ΔD (at initial 1.0 density) |
|---|---|
| Compound 1 | −0.13 |
| Control 1 | −0.31 |
| Control 2 | −0.56 |
| Control 3 | −0.66 |
| Control 4 | −0.56 |
| Control 5 | −0.36 |

Use of Compound 1 containing a carbamoyloxy group substituted in accordance with the invention showed superior light stability as compared to a control dye of similar structure without this substituent (Control 1) and other control dyes of related structures.

EXAMPLE 2

The extent of dye retransfer was estimated by taping with pressure the dye image-receiving element face-to-face with a waterproof polyethylene-titanium dioxide overcoated reflective paper support and incubating for 5 days at 49° C., approximately 50% RH. The extent of dye transferred to the reflective support was estimated visually as follows:

TABLE 3

| Dye | Retransfer Observed |
|---|---|
| Compound 1 | No |
| Control 1 | Yes |
| Control 2 | Yes |
| Control 3 | No |
| Control 4 | Yes |
| Control 5 | Yes |

No significant retransfer was visually observed for the dye employed in the invention. All control dyes, with the exception of Control dye 3, showed a greater degree of dye retransfer. Control dye 3, however, as shown in Example 1, had the worst stability to light.

EXAMPLE 3

(A) A yellow dye-donor element was prepared by coating the following layers in the order recited on a 6 μm poly(ethylene terephthalate) support:

(1) Dye-barrier layer of poly(acrylic acid) (0.16 $g/m^2$) coated from water, and (2) Dye layer containing a yellow dye as identified in the following Table 4 (0.62 $mmoles/m^2$) and FC-431 ® surfactant (3M Corp.) (0.0022 $g/m^2$) in cellulose acetate (40% acetyl) (at a weight equal to 1.2× that of the yellow dye) coated from a 2-butanone and cyclohexanone solvent mixture.

On the back side of the element was coated a slipping layer of the type disclosed in U.S. patent application Ser. No. 813,199 of Vanier et al., filed Dec. 24, 1985, now abandoned.

TABLE 4

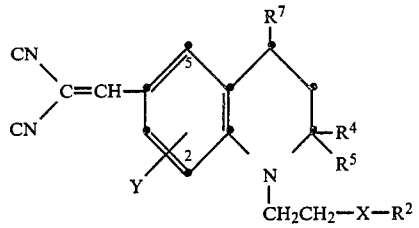

| Dye | $R^7$ | $R^4$ | $R^5$ | Y | X—$R^2$ |
|---|---|---|---|---|---|
| Compound 14 | $CH_3$ | $CH_3$ | $CH_3$ | 3-$CH_3$ | —OCO—NH($C_6H_5$) |
| Compound 15 | $CH_3$ | $CH_3$ | $CH_3$ | 3-$CH_3$ | —OCO—$CH_2OC_6H_5$ |
| Compound 16 | $CH_3$ | $CH_3$ | $CH_3$ | 2-$OCH_3$ 5-$CH_3$ | —OCO—NH[$C_6H_5$—3,5-$(OCH_3)_2$] |
| Compound 17 | $CH_3$ | $CH_3$ | $CH_3$ | 2-$OCH_3$ 5-$CH_3$ | —OCO—($C_6H_4$—4-$CO_2CH_3$) |
| Compound 18 | $CH_3$ | $CH_3$ | $CH_3$ | 2-$OCH_3$ 5-$CH_3$ | —N(—$CH_3$)(—$SO_2C_6H_5$) |
| Compound 19 | $CH_3$ | $CH_3$ | $CH_3$ | 3-$CH_3$ | 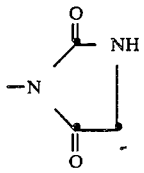 |
| Control 2 | H | $CH_3$ | H | 2-$OCH_3$ 5-$CH_3$ | Cl |
| Control 6 | H | $CH_3$ | H | 2-$OCH_3$ 5-$CH_3$ | 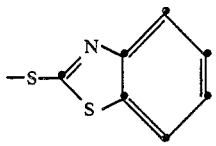 |
| Control 7 | $CH_3$ | $CH_3$ | $CH_3$ | 3($NHCOC_4H_9$—t) | H |

A dye-receiving element was prepared as in Example 1.

The dye side of the dye-donor element strip 1 inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) was pressed with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec.) Coincidentally, the resistive elements in the thermal print head were pulse-heated at increments from 0 to 8.3 msec to generate a graduated density test pattern. The voltage supplied to the print head was approximately 22 v representing approximately 1.6 watts/dot (13 mjoules/dot) for maximum power to the 0.1 $mm^2$ area pixel.

The dye-receiving element was separated from each dye-donor element and the Status A blue densities of the step image were read. The image was then subjected to "HID-fading": 7 days, 50 kLux, 5400° K., 32° C., approximately 25% RH. The density loss near mid scale was calculated.

The following dye stability data were obtained:

TABLE 5

| Dye | Initial Density | Density Loss (%) |
|---|---|---|
| Compound 1 | 1.1 | 35 |
| Compound 2 | 1.4 | 34 |
| Compound 3 | 1.0 | 29 |
| Compound 4 | 1.0 | 25 |
| Compound 5 | 0.8 | 28 |
| Compound 6 | 0.9 | 36 |
| Compound 7 | 1.2 | 49 |
| Compound 8 | 1.5 | 44 |

TABLE 5-continued

| Dye | Initial Density | Density Loss (%) |
|---|---|---|
| Control 2 | 1.7 | 87 |
| Control 6 | 0.7 | 68 |
| Control 7 | 0.7 | 77 |

Use of the compounds substituted in accordance with the invention showed superior light stability as compared to control dyes of similar structure without this substituent.

The invention has been described in detail with particular reference to preferred embodiments thereof, but it will be understood that variations and modifications can be effected within the spirit and scope of the invention.

What is claimed is:

1. A yellow dye-donor element for thermal dye transfer comprising a support having thereon a dye layer comprising a yellow dye dispersed in a polymeric binder, said yellow dye having the formula:

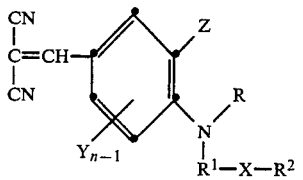

wherein

R is a substituted or unsubstituted alkyl group of from 1 to about 10 carbon atoms; a cycloalkyl group of from about 5 to about 7 carbon atoms; or represents the atoms which when taken together with Z forms a 5- or 6-membered ring;

$R^1$ is an alkylene or substituted alkylene group;

X is —OJO—, —OJ—, —JO—, —OJ$NR^3$—, —$NR^3$J—, —$NR^3$J$NR^3$, —J$NR^3$— or —$NR^3$JO—; J is CO or $SO_2$;

$R^3$ is hydrogen; a substituted or unsubstituted alkyl group of from 1 to about 10 carbon atoms; a substituted or unsubstituted aryl group of from about 6 to about 10 carbon atoms; or represents the atoms which when taken together with $R^2$ forms a 5- or 6-membered ring;

$R^2$ is a substituted or unsubstituted alkyl group of from 1 to about 10 carbon atoms; a cycloalkyl group of from about 5 to about 7 carbon atoms; a substituted or unsubstituted aryl group of from about 6 to about 10 carbon atoms; or represents the atoms which when taken together with $R^3$ forms a 5- or 6-membered ring;

Z is hydrogen or represents the atoms which when taken together with R forms a 5- or 6-membered ring;

Y is a substituted or unsubstituted alkyl or alkoxy group of from 1 to about 6 carbon atoms or halogen; and n is a positive integer from 1 to 4.

2. The element of claim 1 wherein R represents the atoms which are taken together with Z to form a 6-membered ring.

3. The element of claim 2 wherein $R^1$ is ethylene.

4. The element of claim 2 wherein X is —OCONH— or —OCO—.

5. The element of claim 2 wherein X is —$NCH_3SO_2$— or —$NR^3$J—, wherein J is CO and $R^3$ is combined with $R^2$ to form a 5- or 6-membered ring.

6. The element of claim 2 wherein $R^2$ is a substituted aryl group of from about 6 to about 10 carbon atoms or $C_6H_5$.

7. The element of claim 1 wherein a dye-barrier layer is located between said dye layer and said support.

8. The element of claim 1 wherein the side of the support opposite the side having thereon said dye layer is coated with a slipping layer comprising a lubricating material.

9. The element of claim 1 wherein said support comprises poly(ethylene terephthalate).

10. The element of claim 1 wherein said dye layer comprises sequential repeating areas of cyan, magenta and said yellow dye.

11. In a process of forming a dye transfer image comprising imagewise-heating a dye-donor element comprising a support having thereon a dye layer comprising a yellow dye dispersed in a polymeric binder and transferring a yellow dye image to a dye-receiving element to form said yellow dye transfer image, the improvement wherein said yellow dye has the formula:

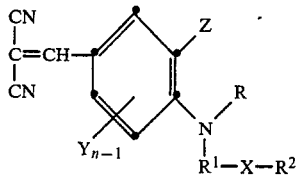

wherein

R is a substituted or unsubstitued alkyl group of from 1 to about 10 carbon atoms; a cycloalkyl group of from about 5 to about 7 carbon atoms; or represents the atom which when taken together with Z forms a 5- or 6-membered ring;

$R^1$ is an alkylene or substituted alkylene group;

X is —OJO—, —OJ—, —JO—, —OJ$NR^3$—, —$NR^3$J—, —$NR^3$J$NR^3$, —J$NR^3$— or —$NR^3$JO—;

J is CO or $SO_2$;

$R^3$ is hydrogen; a substituted or unsubstituted alkyl group of from 1 to about 10 carbon atoms; a substituted or unsubstituted aryl group of from about 6 to about 10 carbon atoms; or represents the atoms which when taken together with $R^2$ forms a 5- or 6-membered ring;

$R^2$ is a substituted or unsubstituted alkyl group of from 1 to about 10 carbon atoms; a cycloalkyl group of from about 5 to about 7 carbon atoms; a substituted or unsubstituted aryl group of from about 6 to about 10 carbon atoms; or represents the atoms which when taken together with $R^3$ forms a 5- or 6-membered ring;

Z is hydrogen or represents the atoms which when taken together with R forms a 5- or 6-membered ring;

Y is a substituted or unsubstituted alkyl or alkoxy group of from 1 to about 6 carbon atoms or halogen; and n is a positive integer from 1 to 4.

12. The process of claim 11 wherein said support is poly(ethylene terephthalate) which is coated with sequential repeating areas of cyan, magenta and said yellow dye, and said process steps are sequentially performed for each color to obtain a three-color dye transfer image.

13. In a thermal dye transfer assemblage comprising:

(a) a yellow dye-donor element comprising a support having thereon a dye layer comprising a yellow dye dispersed in a polymeric binder, and (b) a dye-receiving element comprising a support having thereon a dye image-receiving layer, said dye-receiving element being in a superposed relationship with said yellow dye-donor element so that said dye layer is in contact with said dye image-receiving layer, the improvement wherein said yellow dye has the formula:

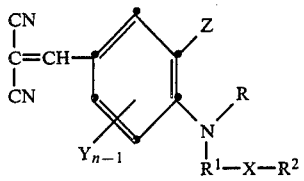

wherein

R is a substituted or unsubstituted alkyl group of from 1 to 10 carbon atoms; a cycloalkyl group of from about 5 to about 7 carbon atoms; or represents the atoms which when taken together with Z forms a 5- or 6-membered ring;

$R^1$ is an alkylene or substituted alkylene group;

X is —OJO—, —OJ—, —JO—, —OJNR$^3$—, —NR$^3$J—, —NR$^3$JNR$^3$, —JNR$^3$— or —NR$^3$JO—;

J is CO or $SO_2$;

$R^3$ is hydrogen; a substituted or unsubstituted alkyl group of from 1 to about 10 carbon atoms; a substituted or unsubstituted aryl group of from about 6 to about 10 carbon atoms; or represents the atoms which when taken together with $R^2$ forms a 5- or 6-membered ring;

$R^2$ is a substituted or unsubstituted alkyl group of from 1 to about 10 carbon atoms; a cycloalkyl group of from about 5 to about 7 carbon atoms; a substituted or unsubstituted aryl group of from about 6 to about 10 carbon atoms; or represents the atoms which when taken together with $R^3$ forms a 5- or 6-membered ring;

Z is hydrogen or represents the atoms which when taken together with R forms a 5- or 6-membered ring;

Y is a substituted or unsubstituted alkyl or alkoxy group of from 1 to about 6 carbon atoms or halogen; and n is a positive integer from 1 to 4.

14. The assemblage of claim 13 wherein R represents the atoms which are taken together with Z to form a 6-membered ring.

15. The assemblage of claim 14 wherein $R^1$ is ethylene.

16. The assemblage of claim 14 wherein X is —OCONH— or —OCO—.

17. The assemblage of claim 14 wherein X is —NCH$_3$SO$_2$— or —NR$^3$J—, wherein J is CO and $R^3$ is combined with $R^2$ to form a 5- or 6-membered ring.

18. The assemblage of claim 14 wherein $R^2$ is a substituted aryl group of from about 6 to about 10 carbon atoms or $C_6H_5$.

19. The assemblage of claim 13 wherein said support of the dye-donor element comprises poly(ethylene terephthalate).

* * * * *